US011702791B2

(12) United States Patent
Choi et al.

(10) Patent No.: US 11,702,791 B2
(45) Date of Patent: Jul. 18, 2023

(54) LAUNDRY TREATING APPARATUS

(71) Applicant: LG ELECTRONICS INC., Seoul (KR)

(72) Inventors: Yoonsung Choi, Seoul (KR); Cheolhwan Kim, Seoul (KR); Sedong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 449 days.

(21) Appl. No.: 17/122,513

(22) Filed: Dec. 15, 2020

(65) Prior Publication Data

US 2021/0222352 A1 Jul. 22, 2021

(30) Foreign Application Priority Data

Jan. 16, 2020 (KR) ..... 10-2020-0006092

(51) Int. Cl.

| | |
|---|---|
| ***D06F 58/26*** | (2006.01) |
| ***D06F 58/24*** | (2006.01) |
| ***D06F 58/38*** | (2020.01) |
| ***D06F 34/26*** | (2020.01) |
| ***D06F 58/04*** | (2006.01) |
| ***D06F 105/28*** | (2020.01) |
| ***D06F 105/32*** | (2020.01) |
| ***D06F 103/34*** | (2020.01) |

(52) U.S. Cl.

CPC ..... *D06F 58/26* (2013.01); *D06F 34/26* (2020.02); *D06F 58/04* (2013.01); *D06F 58/24* (2013.01); *D06F 58/38* (2020.02); *D06F 2103/34* (2020.02); *D06F 2105/28* (2020.02); *D06F 2105/32* (2020.02)

(58) Field of Classification Search

CPC ..... D06F 58/26; D06F 58/38; D06F 34/26; D06F 2105/32; D06F 2105/34; D06F 2105/28

USPC ..... 34/595–610

See application file for complete search history.

(56) References Cited

U.S. PATENT DOCUMENTS 3,805,404 A * 4/1974 Gould ..... D06F 58/04 34/77
4,242,808 A 1/1981 Luthi
4,447,965 A 5/1984 Bray
(Continued)

FOREIGN PATENT DOCUMENTS

CN 102677438 9/2012
CN 203904734 10/2014
(Continued)

OTHER PUBLICATIONS

Korean Office Action issued in Application No. 10-2020-0006092 dated Jun. 28, 2021.
(Continued)

*Primary Examiner* — Stephen M Gravini
(74) *Attorney, Agent, or Firm* — Ked & Associates

(57) ABSTRACT

A laundry treating apparatus may include a drum in which laundry is stored, an air flow passage through which air is circulated, and a heating duct configured to supply hot air to the drum. The air flow passage and heating duct may be configured to prevent or reduce or cooling or condensing of moisture in the circulated air. A steam compressor may be provided to compress some of the air flowing through the air flow passage.

20 Claims, 9 Drawing Sheets

(56) References Cited

U.S. PATENT DOCUMENTS

| | | | | |
|---|---|---|---|---|
| 4,621,438 | A * | 11/1986 | Lanciaux | D06F 58/06 34/604 |
| 5,228,211 | A | 7/1993 | Stubbing | |
| 5,291,668 | A | 3/1994 | Becker et al. | |
| 6,585,781 | B1 | 7/2003 | Roseen | |
| 7,228,647 | B2 * | 6/2007 | Hong | D06F 25/00 34/604 |
| 8,239,989 | B2 * | 8/2012 | Im | D06F 35/00 68/5 R |
| 8,484,860 | B2 * | 7/2013 | Moon | D06F 58/10 38/14 |
| 8,739,433 | B2 * | 6/2014 | Da Riol | D06F 58/20 68/5 R |
| 8,756,828 | B2 * | 6/2014 | Dalton | D06F 33/57 34/597 |
| 8,844,163 | B2 * | 9/2014 | Palazzin | F26B 21/004 34/139 |
| 11,629,452 | B2 * | 4/2023 | Kang | D06F 58/10 68/5 C |
| 2016/0138208 | A1 * | 5/2016 | Bison | D06F 58/20 34/131 |
| 2017/0145624 | A1 | 5/2017 | Dulberg et al. | |
| 2019/0145043 | A1 * | 5/2019 | Beers | D06F 58/10 34/595 |
| 2021/0222352 | A1 * | 7/2021 | Choi | D06F 58/38 |

FOREIGN PATENT DOCUMENTS

| | | | | |
|---|---|---|---|---|
| CN | 104593991 | | 5/2015 | |
| CN | 106480680 | | 3/2017 | |
| DE | 20101641 | | 6/2002 | |
| DE | 600 13 096 | | 3/2005 | |
| EP | 1408151 | A1 * | 4/2004 | D06F 58/24 |
| EP | 3757278 | A1 * | 12/2020 | D06F 58/50 |
| JP | 2014-018393 | | 2/2014 | |
| KR | 10-2009-0016916 | | 2/2009 | |
| KR | 2012040383 | A * | 4/2012 | |
| KR | 10-2015-0124353 | | 11/2015 | |

OTHER PUBLICATIONS

Chinese Office Action dated Oct. 8, 2022 issued in Application No. 202011637523.9.

* cited by examiner

LAUNDRY TREATING APPARATUS

CROSS-REFERENCE TO RELATED APPLICATION(S)

This application claims the benefit of Korean Patent Application No. 10-2020-0006092, filed on Jan. 16, 2020, whose entire disclosure(s) is/are hereby incorporated by reference.

BACKGROUND

1. Field

The present disclosure relates to a laundry treating apparatus that compresses air or moisture.

2. Background

A laundry treating apparatus may refer to an apparatus including a washing machine capable of performing a washing process to remove foreign substances in laundry, a dryer that performs a drying process of removing moisture from the laundry, and/or a refresher that performs refreshment for removing dust or germs from the laundry. A brand name for a refresher is LG Electronics' (LGE's) Tromm Styler.

In recent years, there is a trend in which not only the dryer, but also the washing machine and the refresher are arranged to supply at least one of hot air and steam to the laundry to perform the drying process. FIG. 1 shows a laundry treating apparatus that is able to perform a drying process. See Korean Patent Publication Application No. 10-2009-0016916.

Referring FIG. 1, the laundry treating apparatus may include a cabinet 100 forming an exterior or outer appearance, a drum 200 rotatably provided inside the cabinet 100 to receive or accommodate laundry therein, a driver 300 (e.g., a motor) to rotate the drum 200, a hot air supplier 420 provided in communication with the drum 200 to supply hot air inside the drum, and a circulating portion or mount 500 to support or receive the hot air supplier 420. The hot air supplier 420 may be installed at the circulation portion 500.

The driver 300 may include a belt 340 that is wound on an outer circumferential surface of the drum 200 to transmit power of the driver 300. The driver 300 may rotate the drum 200 by rotating the belt 340. Thus, the laundry accommodated in the drum 200 may be evenly exposed to the hot air.

The circulating portion 500 and the drum 200 may be in communication with each other through a drying duct 410. The drying duct 410 may include a discharge duct 411 and a suction duct 412. The discharge duct 411 may be provided in communication with one side of the drum 200 to discharge moisture of the laundry and the air that has passed through the laundry from the drum 200. The suction duct 412 may be provided in communication with one of one side and the other side of the drum to suction or push the air that has passed through the hot air supplier 420 back to the drum 200.

The hot air supplier 420 may include a heat exchanger such as an evaporator 422, a condenser 423, etc. to dry and heat air passing through the circulating portion 500. In one example, although not shown, the hot air supplier 420 may further include a blower fan that delivers the air inside the drum 200 to the circulating portion 500.

The hot air supplier 420 may include an evaporator 422 to cool the air that has passed through the discharge duct 411, a compressor to compress and heat a refrigerant that has passed through the evaporator 422, a condenser 423 to heat the air with the refrigerant that has passed through the compressor to generate hot and dry air, and an expansion valve to reduce a temperature by expanding the refrigerant that has passed through the condenser 423. The hot air supplier 420 may be formed as a heat pump.

When the hot air supplier 420 is operated, the refrigerant compressed with a high temperature and a high pressure in the compressor may discharge heat while passing through the condenser 423. Thereafter, the refrigerant may flow into the expansion valve and expands with a low temperature and a low pressure. Then, the refrigerant may flow into the evaporator 422 to absorb the heat and then flows back into the compressor to be compressed. The condenser 423 may dissipate the heat to surroundings, and the evaporator 422 may absorb the surrounding heat.

When the blower fan is driven, the air inside the drum 200 may be discharged to the circulating portion 500 and may be circulated while flowing into the drum 200 again. The air flowed into the circulating portion 500 may be firstly exposed to the evaporator 422 to be cooled, and moisture contained in the air may be condensed. Thereafter, the air from which the moisture has been removed while passing through the evaporator 422 may be exposed to the condenser 423 and heated at a high temperature. Through such a process, the air may be converted into hot and dry air. The air heated in the condenser 423 may flow into the drum 200 again and be brought into contact with the laundry to dry the laundry. The air that has passed through the laundry may be cooled by passing through the evaporator 422 again, and the moisture contained in the air may be condensed and removed.

As such, the laundry treating apparatus may perform the drying process by circulating the refrigerant in the hot air supplier 420. Such a heat pump scheme may be more energy efficient than directly heating air with a heater using electrical energy.

However, such a laundry treating apparatus, in which the hot air supplier including the compressor to compress the refrigerant may be provided separately, may require a separate apparatus to store, accommodate, and circulate the refrigerant that is not directly in contact with the laundry. A separate circuit configuration to accommodate or circulate the refrigerant may be required to be installed inside the laundry treating apparatus in order to cool or heat the air discharged from the drum despite the laundry treating apparatus having a structure in which the refrigerant is completely not in contact with the laundry.

In addition, the refrigerant exposed to the air may contaminate the laundry. In particular, when the refrigerant is flammable, there is a risk that a fire may occur in the laundry treating apparatus.

In one example, the hot air supplier including the compressor, the plurality of heat exchangers, and the expansion valves may be bulky and complicated in configuration. Such a laundry treating apparatus may have a disadvantage in that a separate installation space may be required in addition to the drum accommodating the laundry therein in order to install the hot air supplier.

In addition, because the hot air supplier may have two heat exchangers in the circulating portion through which the air flows, overload may occur in the blower fan. The laundry treating apparatus equipped with the hot air supplier using the refrigerant may have a disadvantage in that high temperature air discharged from the drum may have to be cooled directly through the evaporator. Because energy of the high temperature air and a high humidity discharged from the drum may not be utilized, energy loss and energy waste may result.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DESCRIPTION OF SPECIFIC EMBODIMENTS

Figure 1:
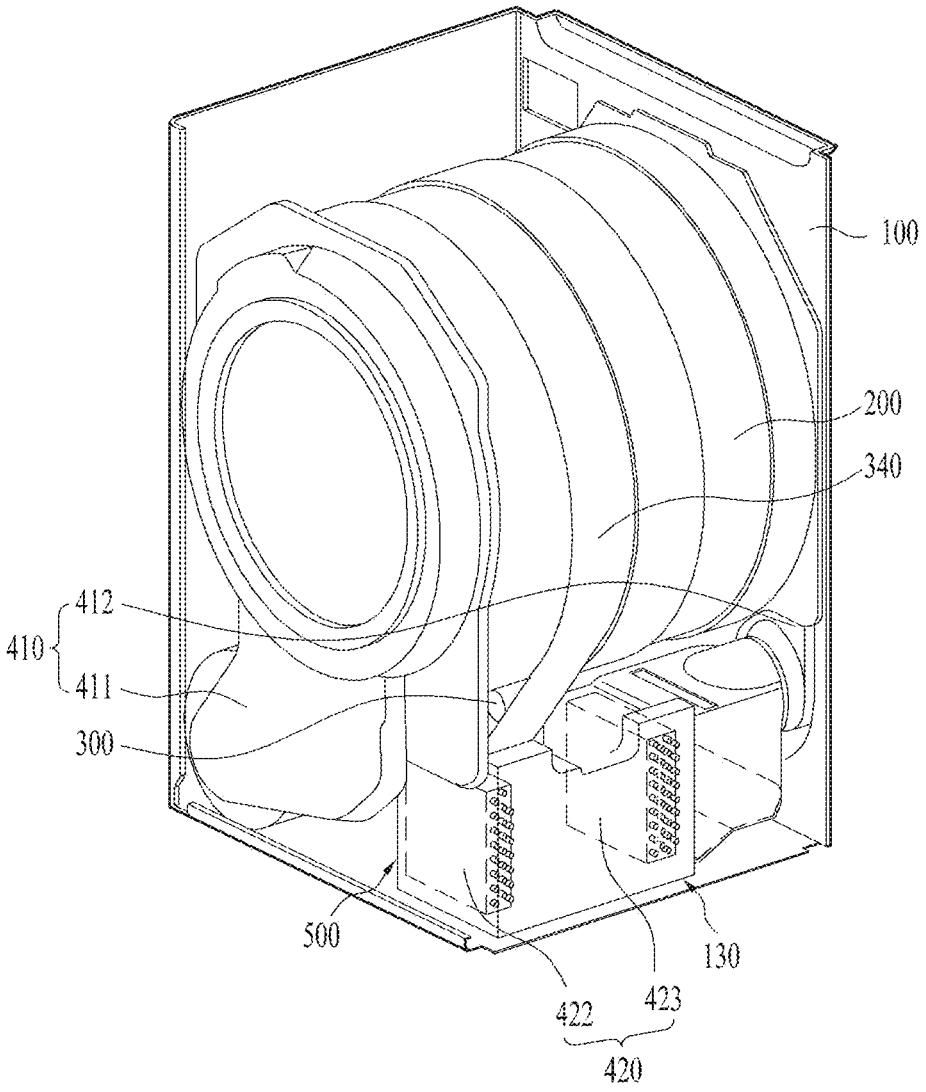
FIG. 1 shows a laundry treating apparatus according to related art.
Figure 2:
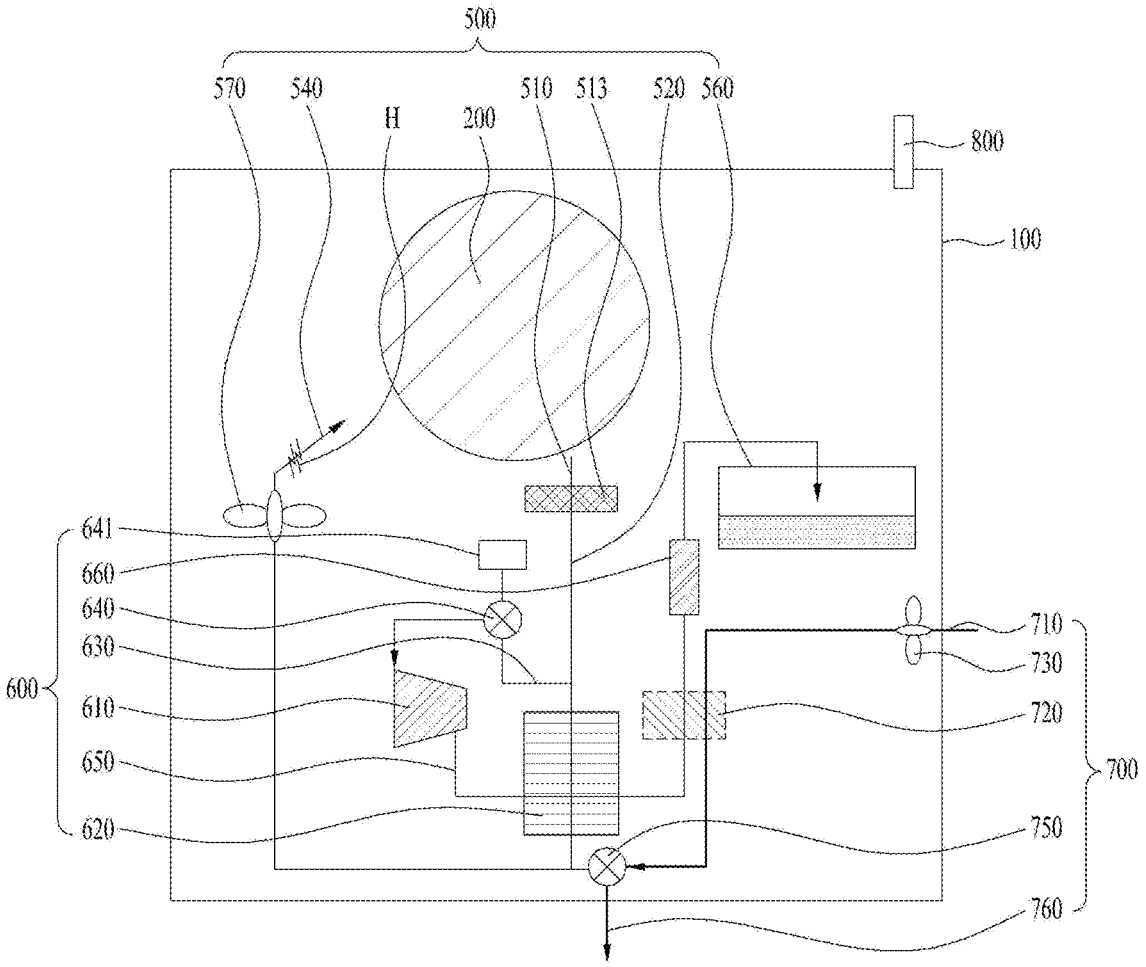
FIG. 2 shows an embodiment of a hot air supplier of a laundry treating apparatus of the present disclosure.

Referring to FIG. 2, a laundry treating apparatus according to an embodiment may include a cabinet 100 forming an exterior or outer appearance of the laundry treating apparatus, a laundry accommodating portion or drum 200 provided inside the cabinet 100 to receive or accommodate laundry therein, and a circulating portion or assembly 500 that is connected to the laundry accommodating portion 200 and circulates air containing moisture discharged from the laundry accommodated inside the drum 200. The laundry treating apparatus may include a branched heater 600 to extract air from the circulating portion 500, compress the air, and heat the air flowing through the circulating portion 500 using the compressed air.

The laundry treating may omit the hot air supplier of the laundry treating apparatus of the related air that heats the air of the drum 200 while circulating the refrigerant. As a result, the laundry treating apparatus according to an embodiment of the present disclosure may replace the heat pump system of the related art with the branched heater 600, saving space where the heat pump would have been installed, and not using the refrigerant itself, so that there is no need to store or accommodate the refrigerant and there is no need to consider leakage of the refrigerant, increasing a convenience of installation. In addition, a design of the laundry treating apparatus according to an embodiment may not need to consider a flow path through which the refrigerant flows, simplifying a structure of the circulating portion 500.

In one example, the laundry treating apparatus may be formed as a dryer, but may be formed as a washing machine or a refresher when the branched heater 600 is able to be applied. Hereinafter, for convenience of description, the laundry treating apparatus according to an embodiment of the present disclosure will be described as being formed as a dryer.

The drum 200 of the laundry treating apparatus may be rotatably provided in the cabinet 100. A driver 300 (FIG. 3) may rotate the drum 200. The driver 300 may include a pulley and a belt 340. Alternatively, the driver 300 may be formed as a direct drive (DD) type and may directly rotate a rotation shaft coupled to the drum 200.

The circulating portion 500 may be arranged below the drum 200. Alternatively, the circulating portion 500 may be provided on a side face of the drum 200 or above the drum 200 while still in communication with the drum 200 to supply hot air of a high temperature to the drum 200.

Figure 7:
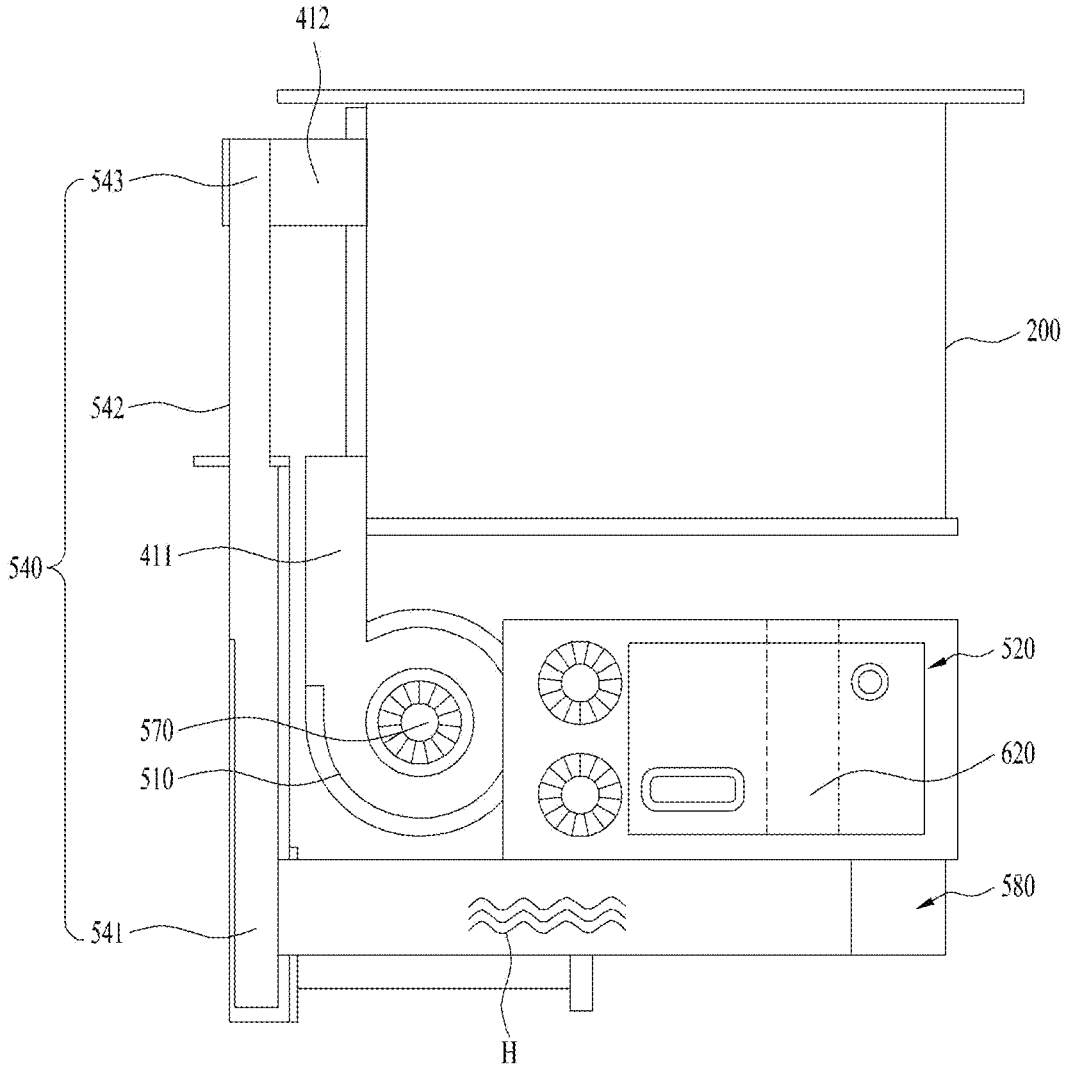
FIG. 7 shows an embodiment in which a heating duct of the present disclosure is installed.

The laundry treating apparatus may be formed in a circulating type in which the circulating portion 500 may be in communication with both ends of the drum 200 through a drying duct 410 (FIG. 7). Alternatively, the circulating portion 500 may be formed in an exhaust type rather than the circulating type when the hot air is able to be supplied to the drum 200. Hereinafter, for convenience of description, a circular type will be described.

Figure 8:
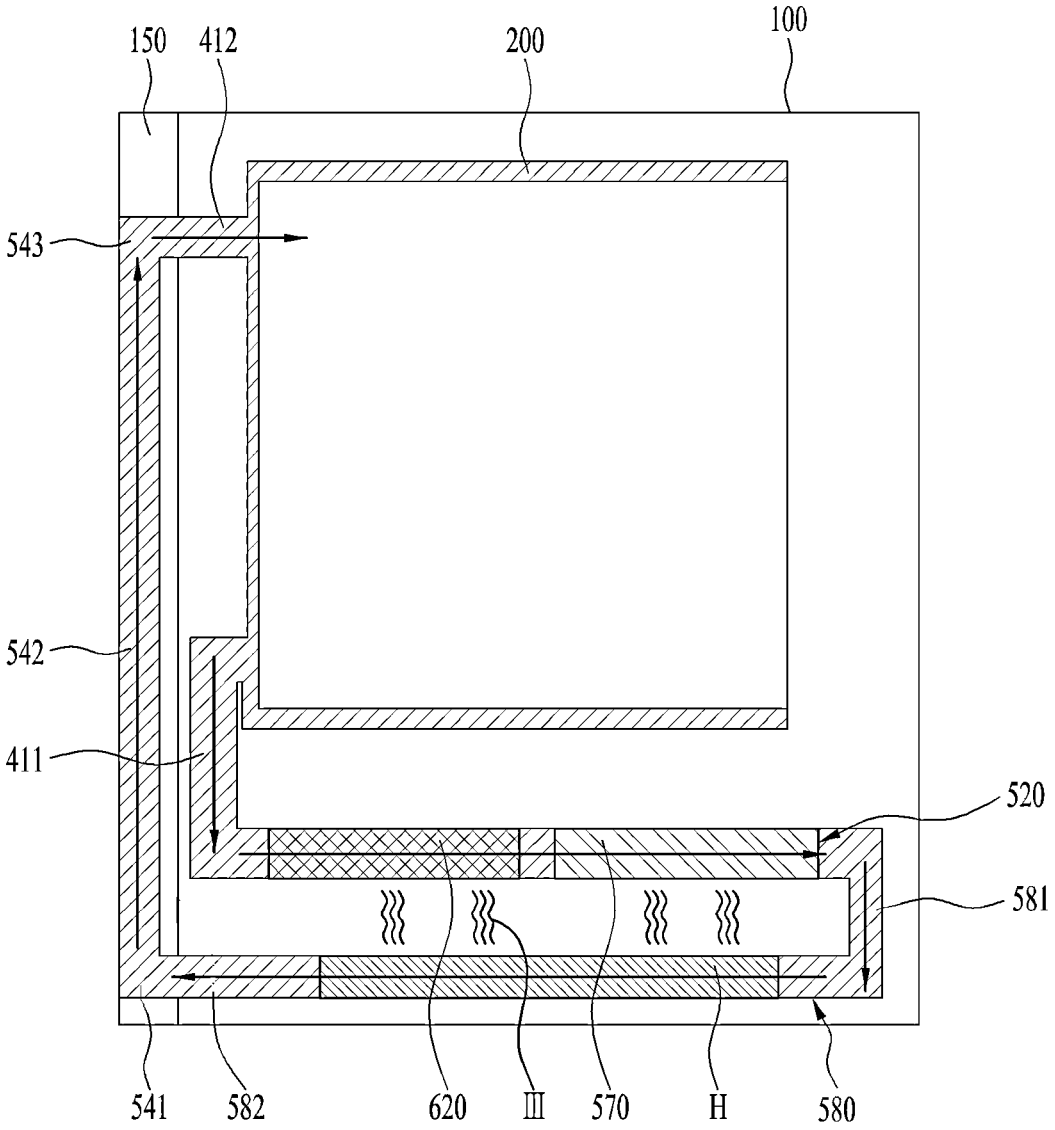
FIG. 8 is a conceptual diagram showing a structure of a flow path of a laundry treating apparatus of the present disclosure.
Figure 9:
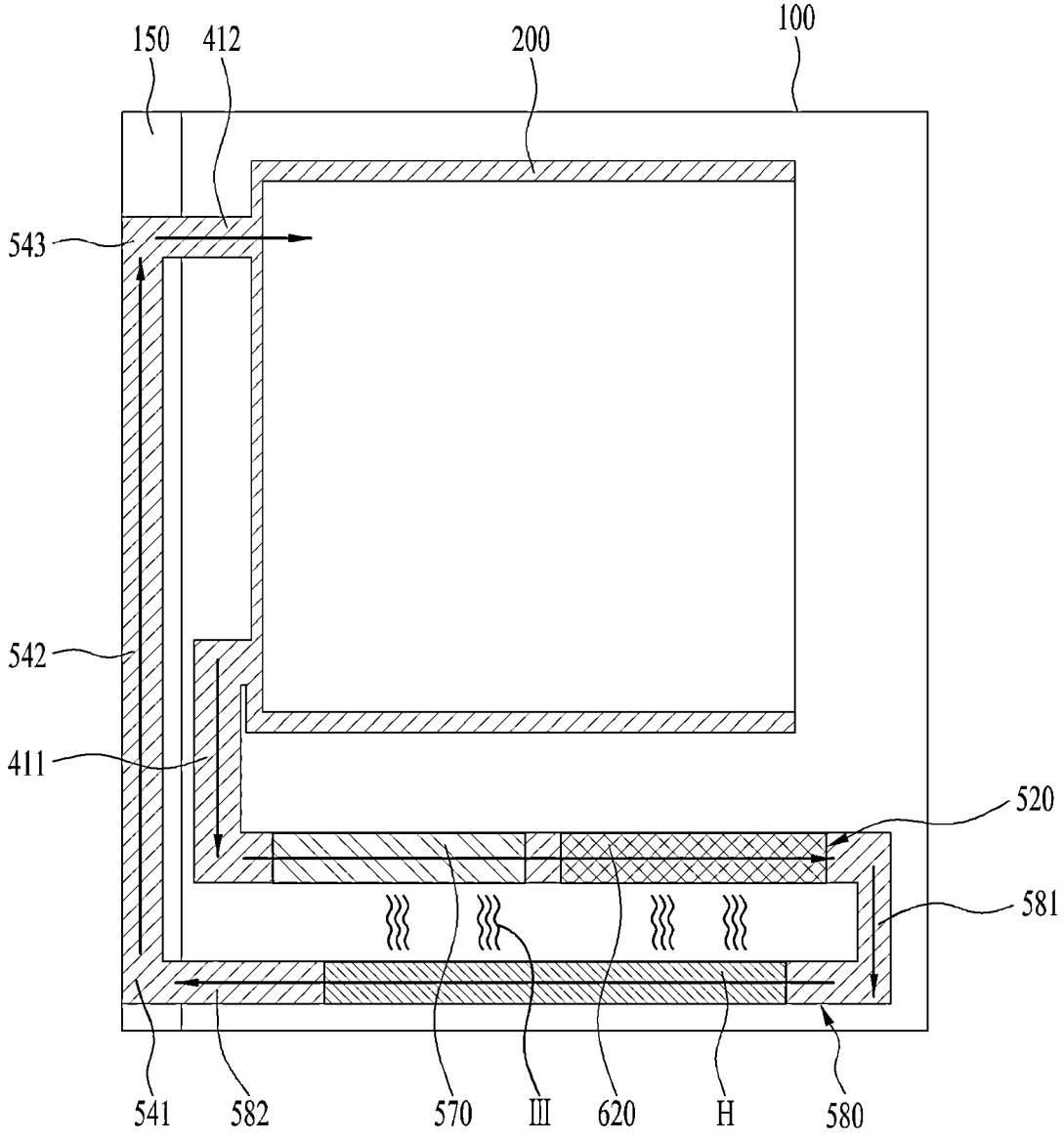
FIG. 9 shows another embodiment of a structure of a flow path of a laundry treating apparatus of the present disclosure.

The circulating portion 500 and the drum 200 may be in communication with each other through the drying duct 410. The drying duct 410 may include a discharge duct 411 in communication with one side of the drum 200 to discharge the moisture of the laundry and the air passed through the laundry from the drum 200 and a suction duct 412 in communication with one of one side and the other side of the drum to suction or push the air back into the drum 200 (FIGS. 7-9). The circulating portion 500 may further include a blower fan 570 that suctions the air of the drum 200 to the circulating portion 500 or blows or injects the air of the circulating portion 500 into the drum 200. The discharge duct 411 may alternatively be referred to as an outlet duct, and the suction duct 412 may alternatively be referred to as an inlet duct.

The circulating portion 500 may include a plurality of ducts or passages such as a discharge connecting duct 510 in communication with the discharge duct 411 to receive the air of the drum 200, an air flow portion or passage 520 through which the air introduced through the discharge connecting duct 510 passes and forms a flow path that may be heated by the branched heater 600, and a suction connecting duct 540 in communication with the suction duct 412 to guide the air that has passed through the air flow portion 520 to the drum 200. The blower fan 570 may be installed in the circulating portion 500 so that the air inside the drum 200 may be circulated through the circulating portion 500. Accordingly, the air of the drum 200 may flow into the discharge connecting duct 510, pass through the air flow portion 520, and then flow back into the drum 200 through the suction connecting duct 540. Alternatively or in addition thereto, the air flow portion 520 may be a duct.

The branched heater 600 may be configured to heat the air flowing through the circulating portion 500 without a separate refrigerant. The branched heater 600 may include a branch pipe 630 to extract a portion of the air flowing through the circulating portion 500, a steam compressor 610 to compress the air that has flowed into the branch pipe 630, and a heat supplier or heater 620 that is provided inside the circulating portion 500 and heats the air circulating in the circulating portion 500 with the air compressed by the steam compressor 610.

The air flowing through the circulating portion 500 may carry moisture contained in the laundry accommodated in the drum 200, which may be evaporated or compressed. The air flowing through the circulating portion 500 may contain the moisture transferred from the laundry. As a result, the steam compressor 610 may simultaneously compress the moisture discharged from the laundry as well as the air. Even when the air itself is incompressible, the moisture contained in the air may be compressed so that the injected air may be compressed at a high temperature and a high pressure in the steam compressor 610. The air compressed at the high temperature and the high pressure in the steam compressor 610 may contain steam of the high temperature.

In one example, the air or the steam of the high temperature and the high pressure compressed in the steam compressor 610 may be transferred to the heat supplier 620 through a heat supply pipe 650. The heat supply pipe 650 may pass through the heat supplier 620. The heat supplier 620 may be formed as a heat exchanger to dissipate heat of the air passing through the heat supply pipe 650 to the outside.

The heat supplier 620 may be located or installed inside the circulating portion 500. The heat supplier 620 may be provided at the air flow portion 520 to heat the air or the moisture flowing through the circulating portion 500. Thus, the heat supplier 620 may exchange heat between the air discharged from the drum 200 and passing through the circulating portion 500 and the air passing through the heat supply pipe 650.

In one example, the high temperature air or steam flowing through the heat supply pipe 650 may exchange heat with the air or the moisture passing through the circulating portion 500. As a result, the air discharged from the drum 200 and that has not flowed into the branch pipe 630 but has flowed into the air flow portion 520 may be heated while passing through the circulating portion 500. The air heated while passing through the heat supplier 620 may flow back into the drum 200 to dry the laundry. The air containing the moisture while drying the laundry may be again discharged from the drum 200. A portion of the air may flow into the branch pipe 630, and a remaining portion of the air may flow into the air flow portion 520. The portion of the air that flowed into the branch pipe 630 and the remaining portion of the air that flowed into the air flow portion 520 may exchange heat with each other. As the air of the drum 200 is continuously circulated and heated, the laundry of the drum 200 may be dried.

In one example, the air that has flowed into the steam compressor 610 may be heated to a higher temperature, as a moisture content may be higher. Because the drum 200 may be in a low temperature state at the beginning of a drying process, the moisture contained in the laundry may not easily evaporate. Driving the steam compressor 610 at the beginning of the drying process may be less efficient. In some cases, because the air that has passed through the steam compressor 610 may not be heated, the drying process itself may not be possible.

In order to improve this, the laundry treating apparatus e may further include a heater H that directly heats the air flowing through the circulating portion 500 inside the circulating portion 500. The heater H may be formed as any component, such as a sheath heater, that may be configured to dissipate the heat by receiving energy. The heater H may be separate from the heat supplier 620 of the branched heater 600. The heater H may alternatively be referred to as a first heater, and the heat supplier 620 may alternatively be referred to as a second heater.

In order to evaporate the moisture from the laundry accommodated in the drum 200, the heater H may be located inside the drum 200 or may be provided in the circulating portion 500. In one example, the heater H may be provided in the circulating portion 500 to heat the air injected into the drum 200 to a high temperature so that the laundry will be dried faster, thereby increasing a humidity of the air discharged to the drum 200 faster. The heater H may be provided at the suction connecting duct 540 such that the air passing through the circulating portion 500 may be injected into the drum 200 without heat loss.

The branched heater 600 may further include a branch determining portion 640 that adjusts opening and closing of the branch pipe 630. The branch determining portion or valve 640 to adjust an opening and closing of the branch pipe 630. The branched heater 600 may include an opening and closing controller 641 that controls the branch determining portion 640 to determine the opening and/or closing of the branch pipe 630.

When sensing or receiving a signal indicating that a humidity of the air flowing through the branch pipe 630 or the circulating portion 500 is equal to or greater than a reference or predetermined value, the opening and closing controller 641 may adjust the branch determining portion 640 to open the branch pipe 630. A humidity sensor may be placed in the circulating portion 500 to sense humidity, or the opening and closing controller 651 itself may be provided to sense the humidity. The reference value may correspond to a minimum humidity at which the steam compressor 610 is able to compress the air to generate a heating effect.

The laundry treating apparatus may circulate the air of the drum 200 to the circulating portion 500 while initially driving the blower fan 570 and the heater H. In this process, the circulated air may be dried at the high temperature as being heated by the heater H. Further, the humidity of the air may be increased as the air is in contact with the laundry of the drum 200. When the humidity is equal to or above the reference value, the opening and closing controller 641 may open the branch determining portion 640, and the portion of the air flowing through the circulating portion 500 may flow into the branch pipe 630 and be heated in the steam compressor 610. Accordingly, the heated air may heat the remaining portion of the air flowing through the circulating portion 500 while passing through the heat supplier 620. The air flowing through the circulating portion 500 that has passed through the heat supplier 620 may flow into the drum 200 to dry the laundry of the drum 200 faster.

In this process, the heater H may be driven simultaneously with the steam compressor 610 to further heat the air passing through the suction connecting duct 540. When the steam compressor 610 starts to be driven, the heater H may be controlled to stop being driven. In addition, the steam compressor 610 and the heater H may be controlled to be driven simultaneously for a certain or predetermined period of time.

In one example, the air introduced through the branch pipe 630 may flow into the drum 200 after flowing along the steam compressor 610 and the heat supply pipe 650. However, the air that has passed through the heat supplier 620 may be cooled while exchanging the heat with air passing through the circulating portion 500, so that the air that has passed through the heat supplier 620 may not contribute significantly to drying the laundry of the drum 200. In addition, as the air passed through the heat supplier 620 is cooled with the air passing through the circulating portion 500, the moisture of the air passed through the heat supplier 620 may be partially condensed. Therefore, it may not be appropriate to re-inject the air that has passed through the heat supplier 620 into the drum 200.

The air that has passed through the heat supplier 620 may not flow into the drum 200, and be in communication with a condensate collector 534 (FIG. 3) or a reservoir 560 provided separately from the drum 200. As a result, the air that has flowed into the branch pipe 630 may be finally discharged to the reservoir 560, and condensate may be collected in the reservoir 560. The condensate collector 534 and the reservoir 560 may be integrally formed, or alternatively the reservoir 560 may be formed as a casing and seated on the condensate water collector 534.

The circulating portion 500 may further include a circulating filter 513 provided to remove foreign substances such as lint in the air discharged from the drum 200. An amount of foreign substances flowing into the steam compressor 610 may be reduced, maintaining a performance of the steam compressor 610. In addition, foreign substances may be prevented from accumulating (or less likely to accumulate) in the heat supplier 620, thereby maintaining a heat exchange efficiency of the heat supplier 620. The foreign substances discharged from the drum 200 may be prevented or blocked from flowing into the drum 200 again and re-contaminating the laundry.

In one example, the portion of the air flowing through the drum 200 and the circulating portion 500 may repeatedly leak to the reservoir 560, which may continuously reduce a pressure inside the drum 200. Furthermore, because the air flowing through the drum 200 and the circulating portion 500 may be continuously heated but not cooled, there is a problem in that a temperature inside the cabinet 100 may rapidly increase.

To prevent this, the laundry treating apparatus may further include an external air inlet 700 that may supply air outside the cabinet 100 to the drum 200 or the circulating portion 560 or may guide the air outside the cabinet 100 into the cabinet 100. The external air inlet 700 may include an external air supply pipe 710 that penetrates the cabinet 100 and guides the air outside the cabinet 100 into the cabinet 100, an external air discharge pipe 760 that discharges the air flowed into the external air supply pipe 710 back to the outside of the cabinet 100, and a communicating portion or valve 750 that is capable of flowing or guiding the air supplied to the external air supply pipe 710 into the drum 200 or the circulating portion 500.

The external air supply pipe 710 may be in communication with the circulating portion 500 through the communicating portion 750. The external air supply pipe 710 may also be in communication with the external air discharge pipe 760 through the communicating portion 750. The communicating portion 750 may be formed as a branch pipe, a three-way valve that adjusts opening and/or closing of the branch pipe, etc.

When at least one of the pressure, the temperature, or the humidity of the air flowing through the circulating portion 500 exceeds a specific or predetermined value, a controller may control the communicating portion 750 to allow the air outside the cabinet 100 into the circulating portion 500. As a result, the air flowing through the circulating portion 500 may be diluted with the external air to restore the pressure thereof or lower the temperature or the humidity thereof.

The external air inlet 700 may further include a supply fan 730 that generates a negative pressure inside the external air supply pipe 710 such that the external air may be more effectively guided or flowed into the external air supply pipe 710. In one example, the external air inlet 700 may further include a heat recovery or cooling portion or duct 720 that condenses the moisture in the air by further cooling the air flowing through the heat supply pipe 650 with the air introduced from the external air supply pipe 700.

The heat recovery portion 720 may be formed as a heat exchanger so that both the external air supply pipe 710 and the heat supply pipe 650 may pass through the heat recovery portion 720. As a result, the air passing through the heat supply pipe 650 may be primarily cooled in the heat supplier 620 by the air passing through the circulating portion 500, and then may be secondarily cooled by the air passing through the external air supply pipe 710 while passing through the heat recovery portion 720. Even when the air passing through the heat supply pipe 650 is not sufficiently cooled while passing through the circulating portion 500 or the moisture contained in the air is not sufficiently condensed, the air passing through the heat supply pipe 650 may be sufficiently cooled while passing through the heat recovery portion 720, and a considerable amount of the moisture contained therein may also be condensed.

Air of a low temperature and a low pressure may be discharged to the condensate collector 534 or the reservoir 560 so that an interior of the cabinet 100, which may include the condensate collector 534 or the reservoir 560, may be prevented from being heated unnecessarily. At the same time, a large amount of water evaporated from the laundry may be collected in the condensate collector 534 or the reservoir 560.

The external air heated through the heat recovery portion 720 may flow into the circulating portion 500 through the communicating portion 750 as necessary. Accordingly, a performance of drying the air flowing through the circulating portion 500 may be improved by lowering the humidity of the air inside the circulating portion 500 or by additionally heating the air flowing through the circulating portion 500.

In one example, the branched heater 600 may further include a pressure reducing portion or valve 660 that may reduce the pressure of the air or the steam that has passed through the heat recovery portion 720. The pressure reducing portion 660 may be formed as any component that configured to be coupled to the heat supply pipe 650 to reduce a pressure of fluid flowing. For example, the pressure reducing portion 660 may be formed as an expansion valve.

The pressure reducing portion 660 may also reduce the pressure of the air, which is increased, in the steam compressor 610 to the pressure inside the cabinet 100 again. The pressure inside the reservoir 560 may be maintained to be in equilibrium with the pressure inside the cabinet 100.

The reservoir 560 may be formed as a general plastic container, and the heat supply pipe 650 and the reservoir 560 may be connected to each other in an unsealed state. As the heat supply pipe 650 and the reservoir 560 may be in communication with each other, water or liquid inside the heat supply pipe 650 may be collected into the reservoir 560, and the air inside the heat supply pipe 650 may be discharged out of the reservoir 560.

Even when the reservoir 560 is drawn out of the cabinet 100 and the collected water or liquid is discarded to the outside, a safety accident that may occur due to sudden expansion of the moisture or the air may be prevented, or a possibility of a safety accident may be reduced. In one example, because of the external air inlet 700, a large amount of external air flow into the drum 200. Because the drum 200 may not be in a completely sealed state, the external air may flow into the cabinet 100. Even when the air inside the heat supply pipe 650 is introduced or the air of the high temperature and the high humidity is introduced from the drum 200, the interior of the cabinet 100 may be remained in a low temperature and low humidity state because of the external air inlet 700.

In one example, the laundry treating apparatus may further include a pressure maintaining tube 800 to balance an air condition inside and outside the cabinet 100. When the portion of air flowing through the circulating portion 500 is compressed by the steam compressor 610 to be discharged into the cabinet 100 or the pressure inside the cabinet 100 is increased because of the external air inlet 700, the pressure maintaining pipe 800 may be provided to maintain the pressure inside the cabinet 100.

Because of the branched heater 600, the interior of the cabinet 100 may be temporarily in a high pressure state or a high temperature and high humidity state. Even in this case, it is possible to prevent the state inside the cabinet 100 from becoming different from the state outside the cabinet 100 by discharging the air inside the cabinet 100 to the outside using the pressure maintaining pipe 800.

Because of the external air inlet 700, the air inside the cabinet 100 may remain at a low temperature, low pressure, and low humidity state. When the pressure maintaining pipe 800 to discharge the air inside the cabinet 100 to the outside is installed, a change in a humidity or a temperature of an indoor environment in which the laundry treating apparatus is provided may be minimized.

In one example, when the communicating portion 750 prevents or blocks the air of the external air supply pipe 710 from flowing into the circulating portion 500, the controller may control the supply fan 730 to discharge the air of the external air supply pipe 710 to the external air discharge pipe 760.

For example, when the steam compressor 610 is driven, the controller may control the external air supply pipe 710 to communicate with the external air discharge pipe 760 to continuously supply the air outside the cabinet 100 to the heat recovery portion 720. Accordingly, the air flowing through the heat supplier 650 may be cooled faster.

Figure 3:
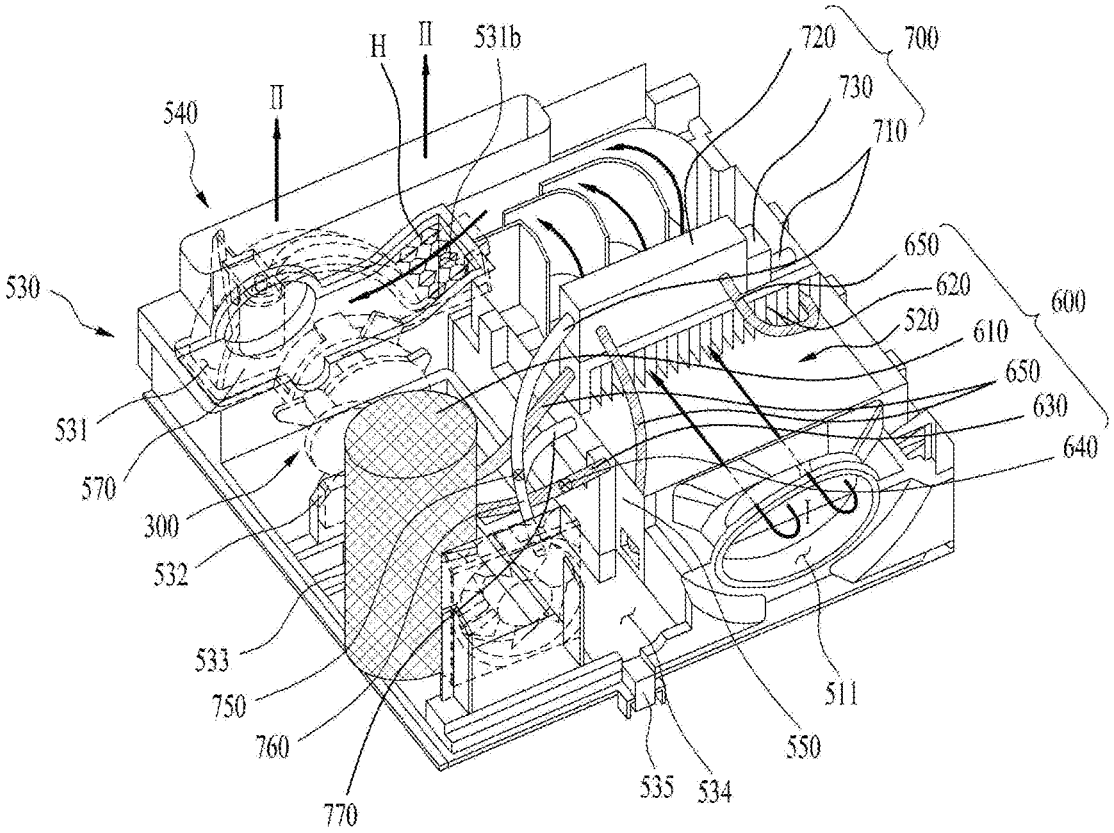
FIG. 3 shows a structure of a laundry treating apparatus of the present disclosure.

Referring to FIGS. 2 and 3, the circulating portion 500 may be formed as a base provided below the drum 200, and the branched heater 600 and the external air inlet 700 may be installed or provided on or above the circulating portion 500. The circulating portion 500 may be provided such that one end thereof is communication with the discharge duct 411 and the other end thereof is in communication with the suction duct 412.

The circulating portion 500 may include the discharge connecting duct 510 in communication with the discharge duct 411, the air flow portion 520 that provides a space in which the air introduced from the discharge connecting duct 510 is heated while passing through the space, the suction connecting duct 540 into which the air that has passed through the air flow portion 520 is suctioned and in communication with the suction duct 412, and an apparatus mounting portion or base 530 that is divided from the air flow portion 520 by a partition 550 and supports various components or devices such as the driver 300 and a drainage pump 535.

Because of the partition 550, the air inside the drum 200 may not leak to the apparatus mounting portion 530 and may be prevented from colliding with another component or device, and an air resistance of the circulating portion 500 may be reduced. A component or device that needs to be in direct contact with the air discharged from the drum 200 may be installed in the air flow portion 520, and a component or device that does not need to be in direct contact with the dry air may be installed on the apparatus mounting portion 530.

The air flow portion 520 may form a flow path through which the air discharged from the drum 200 flows, may be formed as a housing in which the evaporator and the condenser may be installed, and may be divided from the apparatus mounting portion 530 by the partition 550. The discharge connecting duct 510 provided at one end of the air flow portion 520 may be coupled with an outer circumferential surface or an inner circumferential surface of the discharge duct 411 and may include a through hole 511 to allow the air discharged from the discharge duct 411 to flow into the air flow portion 520.

An area of the discharge connecting duct 510 may increase in a direction from the through hole 511 toward the air flow portion 520. An amount of heat exchange of the air in the air flow portion 520 may be increased by slowing a speed of the air introduced from the discharge duct 411.

In one example, a plurality of collecting ribs 521 may be arranged at the other end of the air flow portion 520 to collect the air that has passed through the air flow portion 520 and guide the collected air to the suction connecting duct 540. The collecting ribs 521 may guide hot and dry air or hot air that has passed through the condenser to the suction duct 412 (FIG. 7) while reducing a flow resistance thereof.

The apparatus mounting portion 530 may include a blower fan mounting portion or recess 531 to support or receive the blower fan 570 therein, a driver mounting portion or recess 532 on which the driver 300 may be seated and supported, a compressor mounting portion or recess 533 on which the steam compressor 610 may be supported, and a condensate collector 534 in which the liquid (e.g., water) condensed in the heat supplier 620 and the heat recovery portion 720 may be collected. The drainage pump 535 may be coupled to the condensate collector 534, and the reservoir 560 described above may be installed on a top surface of the condensate collector 534.

Because the blower fan 570 may guide the air to the air flow portion 520, the blower fan mounting portion 531 may respectively communicate with the suction duct 412 and the air flow portion 520. The blower fan mounting portion 531 may be provided such that one surface thereof is penetrated to face distal ends of the plurality of collecting ribs 521 and the other surface thereof facing the suction duct 412 may be penetrated to supply the hot air to the suction duct 412.

In one example, a region where the blower fan mounting portion 531 and the driver mounting portion 532 face each other may have a shaft support 531A to support a driving rotation shaft. A portion of the driver mounting portion 532 facing the compressor mounting portion 533 may have a pulley support 532A to support the other end of the driving rotation shaft.

In one example, the heat supplier 620 and the heat recovery portion 700 may be arranged by coupling a plurality of heat exchange plates made of a metal material and a refrigerant pipe through which the refrigerant flows. A direction in which the air flows and the heat exchange plate may be parallel with each other. In one example, a separation wall parallel to a ground to separate the heat supplier 620 and the heat recovery portion 700 from each other may be installed on the air flow portion 520. The air discharged from the drum 200 may be brought into contact with the heat supplier 620 but may be not be brought into contact with the heat recovery portion 700.

A portion of the high temperature and/or high humidity air discharged from the drum 200 may be cooled while passing through the heat supplier 620 and the heat recovery portion 720. In this process, the moisture contained in the air may be condensed and collected in the condensate collector 534 along the heat supply pipe 650. The drainage pump 535 to discharge the collected condensate in the condensate collector 534 may be installed in the circulating portion 500, or the reservoir 560 to separately collect the condensate may be installed.

In one example, the branch pipe 620 may be provided upstream of the heat supplier 620 to be in communication with the air flow portion 520. The high humidity air discharged from the drum 200 may be guided to the steam compressor 610 before being heated.

The air guided to the steam compressor 610 may be discharged to the heat supply pipe 650 by being heated at a high temperature while being compressed, pass through the heat supplier 620, and then be introduced into the heat recovery portion 700 to flow toward the condensate collector 534. The air that does not flow into the branch pipe 620 may be heated in the heat supplier 620 and flow into the drum 200 through the suction connecting duct 540 in direction II.

The external air introduced from the external air supply pipe 710 may flow to the communicating portion 750 after cooling the heat supply pipe 650 passing through the heat recovery portion 720. The external air inlet 700 may further include an external air absorption pipe 770 through which the communicating portion 750 and/or the external air discharge pipe 760 and the circulating portion 500 may communicate with each other. The external air may be discharged to the outside of the cabinet 100 and may flow into the drum 200 through the air flow portion 520 along the external air absorption pipe 770 based on an opening and/or closing of the communicating portion 750. The air that is lost from flowing into the steam compressor 610 may be compensated.

The blower fan 570 may be installed at a portion of the circulating portion 500 in communication with the air flow portion 520 to circulate the air of the drum 200. The blower fan 570 may be coupled to the driver 300 to receive power. When a driving motor of the driver 300 is operated, the drum 200 may rotate, and at the same time, the blower fan 570 may also circulate the air of the drum 200.

After the air inside the drum 200 passes through the discharge duct 411 in direction I, the blower fan 570 may allow the air to flow through the circulating portion 500 and the hot air supplier 400 into the suction duct 412 (FIG. 7) in direction II.

The heater H may be installed upstream or downstream of the blower fan 570 to heat the air passing through the suction connecting duct 540. In one example, the laundry treating apparatus may include a temperature sensor or a humidity sensor to sense a temperature or a humidity of the air that has passed through the drum 200. For example, the temperature sensor or the humidity sensor may be provided on or in the suction duct 412 (FIG. 7). The controller 641 may control the branch determining portion 640, the steam compressor 610, the external air inlet 700, and the heater H at an appropriate time point through the humidity sensor or the temperature sensor.

The laundry treating apparatus may not require a separate refrigerant because the air or the moisture discharged from the drum 200 may be compressed to be heated. A portion of the air or the moisture discharged from the drum 200 may be compressed to heat the air or the moisture flowing into the drum 200 and heat the air flowed into the drum 200.

In drying the laundry of the drum 200, the laundry treating apparatus may not use a separate refrigerant in addition to the air circulating the drum 200 or the air inside and outside the cabinet 100. The present disclosure may omit an apparatus that circulates refrigerant provided separately from the air or the moisture or store the refrigerant therein. Because a separate refrigerant circuit configuration is not required, manufacturing cost may be reduced, and a structure may be simplified to maximize or increase installation and repair convenience. In addition, there is no need to worry about a loss of refrigerant, improving safety.

Because the air discharged from the drum 200 may be directly heated without being cooled, energy loss may be minimized or reduced. The energy contained in the air discharged from the drum 200 may be utilized. The energy applied to the heater H or the heat supplier 620 may be utilized greatly or to a maximum.

In one example, the present disclosure may not have an evaporator so that a number and an intensity of collisions with the heat exchanger of the air that is injected into the drum 200 may be reduced. A load of the blower fan 570 may be reduced.

Figure 4:
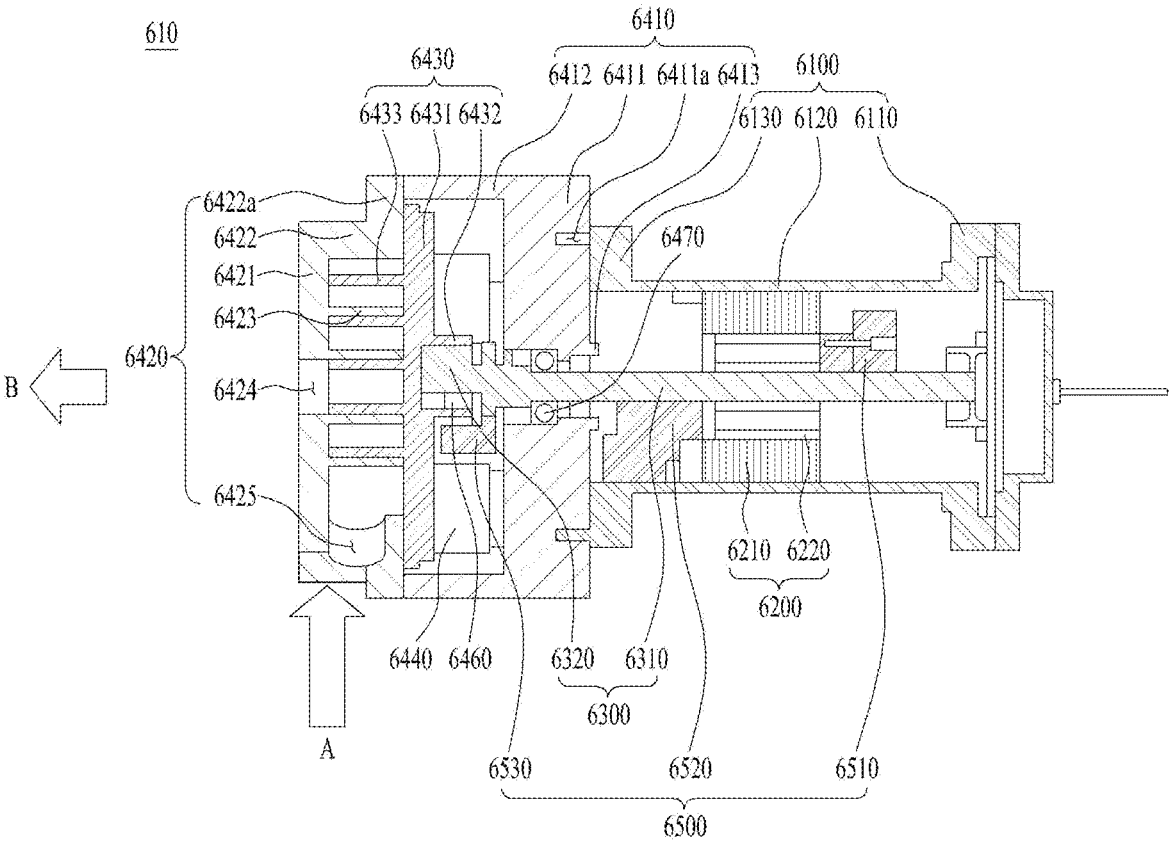
FIG. 4 shows an embodiment of a compressor applied to the present disclosure.

Referring to FIG. 4, the steam compressor 610 may be provided to compress and heat the air, the water, or the moisture instead of a refrigerant. The steam compressor 610 may include a casing 6100 forming an exterior or outer appearance of the steam compressor 610, a driver 6200 coupled to the casing 6100 to rotate a rotation shaft 6300, and a compressing portion or scroll compressor 6400 coupled to the rotation shaft 6300 to compress the moisture or the air.

The casing 6100 may include an accommodating body 6120 to provide a space configured to receive at least one of the driver 6200 or the compressing portion 6400 therein, and an accommodating cover 6110 coupled to one end of the accommodating body 6120 to shield the space. The casing 6100 may be provided to receive both of the driver 6200 and the compressing portion 6400 therein, but may alternatively be configured to receive only the driver 6200 therein. The driver 6200 may include a driving stator 6210 coupled to the accommodating body 6120 to generate a rotating magnetic field and a driving rotor 6220 provided to rotate by the rotating magnetic field to rotate the rotation shaft 6300.

The compressing portion 6400 may include a main frame 6410 coupled to the accommodating body 6120 to allow the rotation shaft 6300 to pass therethrough, a fixed scroll 6420 coupled to the main frame 6410 to provide a compression space in which air or moisture is compressed, and an orbiting scroll 6430 provided in the main frame 6410 and the fixed scroll 6420 and coupled to the rotation shaft 6300 to compress at least one of the air and the moisture.

The main frame 6410 may be accommodated in and coupled to the casing 6100, but may be coupled to a free end of the accommodating body 6120 and exposed to the outside. Because the compressing portion 6400 presses the air or the steam (the moisture), not refrigerant, it may not be necessary to press the air at as a high of a pressure as when compressing refrigerant. Therefore, the compressing portion 6400 may not be provided in the casing 6100 and may be exposed to the outside.

When the compressing portion 6400 is provided in the casing 6100, the compressed moisture may pass through the casing 6100 and be discharged to the outside. While being brought into contact with the casing 6100, the moisture may be partially condensed to remain in the casing 6100, which may cause a short circuit in the driver 6200. The compressing portion 6400 may be exposed to an outside without being provided in the casing 6100. A flow path passing through the compressing portion 6400 and a space in the casing 6100 in which the compressing portion 6400 is provided may be completely separated from each other.

As a result, the compressing portion 6400 may be provided outside of the casing 6100 and be separated from the space in which the driver 6200 is provided. Accordingly, an overall volume of the casing 6100 may be reduced so that a space occupied by the steam compressor 610 may also be reduced or minimized.

The compressing portion 6400 may be provided to compress more moisture or air as a volume of the compressing portion 6400 increases without being limited by a diameter of the casing 6100. The casing 100 may further include a coupling portion 6130 to couple the main frame 6410 and the accommodating body 6120 with each other. The coupling portion 6130 may be formed as a bolt.

The main frame 6410 may include a main end plate 6411 coupled to the accommodating body 6120, a main side plate 6412 extending from the main end plate 6411 to receive the orbiting scroll 6430 therein, and a main shaft accommodating portion or recess 6413 penetrating the main end plate 6411 to receive the rotation shaft 6300 therein.

A main bearing 6470 to support the rotation shaft 6300 when rotating may be installed on an inner circumferential surface of the main shaft accommodating portion 6413. The main end plate 6411 may be have a diameter greater than that of the accommodating body 6120 and may have a screw groove 6411*a* defined therein to be coupled to the coupling portion 6130.

The fixed scroll 6420 may include a fixed end plate 6421 defining a compress space of the air or the moisture therein, and a fixed side plate 6422 extending from the fixed end plate 6421 to receive the orbiting scroll 6430 therein and coupled to the main side plate 6412. The fixed side plate 6422 may further include a fixed coupler 6422*a* that may further expand an area in contact with the main side plate 6412. A diameter of the fixed coupler 6422*a* may be larger than a diameter of the fixed side plate 6422. The fixed coupler 6422*a* and the main side plate 6412 may be coupled to each other in a scheme such as welding, fusing, etc.

The fixed end plate 6421 may further include a fixed wrap 6423 that protrudes toward the main frame 6410 and allows the air or the moisture to be compressed while flowing. The fixed wrap 6423 may extend in a form of a whirlwind or spiral along a circumferential direction of the fixed end plate 6421.

The fixed end plate 6421 may have a discharge hole 6424 defined therein to discharge the compressed moisture or air through an inner distal end or a central portion of the fixed wrap 6423. The fixed side plate 6422 may have an inlet hole 6425 defined in an outer circumferential surface thereof such that the moisture or the air may flow along the fixed wrap 6423.

In one example, the orbiting scroll 6430 may include an orbiting end plate 6431 coupled to the rotation shaft 6300 to orbit or move in an orbital manner, an orbiting shaft accommodating portion or recess 6432 provided on the orbiting end plate 6431 to be coupled to the rotation shaft 6300, and an orbiting wrap 6433 configured to be engaged with the fixed wrap 6423 on the orbiting end plate 6431 to compress the moisture or the air.

The rotation shaft 6300 may include a shaft body 6310 coupled to the rotor 6220 and rotating together with the rotor 6220, and an eccentric portion 6320 extending from the shaft body and provided in the orbiting shaft accommodating portion 6432. The eccentric portion 6320 may be thicker than the shaft body 6310 or may be eccentric with the shaft body 6310 at a side. Accordingly, a rotation radius of the eccentric portion 6320 may be larger than that of the shaft body 6310.

In one example, the orbiting scroll 6430 may further include a compensating coupling portion or recess 6460 provided to compensate for an eccentricity of the eccentric portion 6320. The compensating coupling portion 6460 may support the eccentric portion 6320 to rotate separately from the orbiting shaft accommodating portion 6432 while coupling the eccentric portion 6320 with the orbiting shaft accommodating portion 6432.

When the shaft body 6310 rotates, the eccentric portion 6320 may press the orbiting scroll 6430 in a radial direction of the orbiting scroll 6430. The orbiting wrap 6433 may compress the moisture or the air while being engaged with the fixed wrap 6423 by a pressing force of the eccentric portion 6320.

Because the eccentric portion 6320 may not share a center of gravity with the shaft body 6310, vibration may occur when the rotation shaft 6300 rotates. The steam compressor 610 may further include a balancer 6500 that compensates for the eccentricity of the eccentric portion 6320 and which may prevent or reduce the occurrence of the vibration.

The balancer 6500 may include a main balancer 6520 coupled to the shaft body 6310 or the rotor 6220 in a direction opposite to an eccentric direction from the shaft body 6310 of the eccentric portion 6320. In one example, the balancer 6500 may further include an auxiliary balancer 6510, 6530 to prevent or reduce vibration or eccentricity that may occur because of the main balancer 6520. The auxiliary balancer 6510, 6530 may include at least one of a first auxiliary balancer 6510 spaced apart from the main balancer 6520 and coupled to the rotor 6220, and a second auxiliary balancer 6530 coupled at an opposite side of the eccentric portion 6320. The first auxiliary balancer 6510 may be provided eccentrically in an opposite direction to the main balancer 6520, and the second auxiliary balancer 6530 may be provided eccentrically in an opposite direction to the eccentric portion 6320.

A volume or a weight of the first auxiliary balancer 6510 may be less than a volume or a weight of the main balancer 6520. The main balancer 6520 may be provided between the main frame 6410 and the driver 6200, and the first auxiliary balancer 6510 may be provided between the driver 200 and the casing 100. The second auxiliary balancer 6530 may be provided on an outer circumferential surface of the orbiting shaft accommodating portion 6432.

In one example, the compressing portion 6400 may further include an Oldham's ring 6440 that may prevent the orbiting scroll 6430 from rotating even when the rotation shaft 6300 rotates. The Oldham's ring 6440 may be provided to prevent the orbiting scroll 6430 from rotating with the rotation shaft 6300 even when the orbiting scroll 6430 is pressed by the rotation shaft 6300. The Oldham's ring 6440 may be provided between and coupled to the orbiting scroll 6430 and the main frame 6410 to respectively perform linear reciprocating motions thereto.

When the driver 6200 is driven and the rotation shaft 6300 rotates, a position or orientation of the orbiting scroll 6430 may be varied because of the eccentric portion 6320, so that the orbiting wrap 6433 and the fixed wrap 6423 may be sequentially engaged with each other. The orbiting wrap 6433 and the fixed wrap 6423 may generate at least two compression spaces inwards and outwards, and the air or the moisture may be suctioned from the inlet hole 6425 in direction A by a pressure change.

When the orbiting wrap 6433 and the fixed wrap 6423 are repeatedly engaged with each other, the air or the moisture that flowed into the inlet hole 6425 may be compressed along inner and outer surfaces of the fixed wrap 6423 and discharged to the discharge hole 6424 in direction B. As an alternative to a scroll type compressor, the compressing portion 6400 may be formed as any component or device that is able to compress steam or air.

Figure 5:
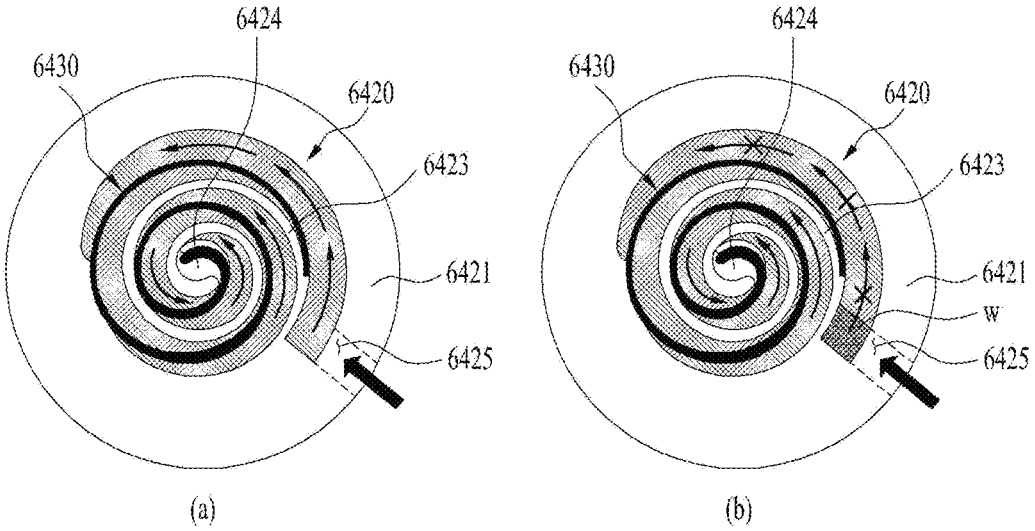
FIG. 5 shows an internal structure of a compressor applied to the present disclosure.

FIGS. 5A and 5B show states of the compressing portion 6400. Referring FIG. 5A, when the moisture or the air flows into the inlet hole 6425, the moisture or the air may flow inwards along the fixed wrap 6423 while flowing inside the fixed side plate 6421.

The orbiting wrap 6433 (a black line in FIGS. 5A and 5B) of the orbiting scroll 6430 may alternately be in contact with inner and outer surfaces of the fixed wrap 6423 based on the rotation of the rotation shaft 6300. In this process, the moisture or the air may be divided and introduced inward and outward of the orbiting wrap 6433 and flow in a direction of the discharge hole 6424. As a volume of the moisture or the air decreases while flowing from the inlet hole 6425 to the discharge hole 6424, the moisture or the air may be compressed and heated at the high temperature and the high pressure.

The air or the moisture that flowed to the innermost portion of the fixed wrap 6423 may be discharged to the discharge hole 6424. As a result, the moisture or the air introduced at the low temperature and the low pressure may be compressed at the high temperature and the high pressure and discharged.

Referring FIG. 5B, the fixed scroll 6420 and the orbiting scroll 6430 may be made of a metal such as steel so that a heat transfer rate is high. Accordingly, when the moisture or the air comes into contact with the fixed scroll 6620 or the orbiting scroll 6430, the moisture or the air may be cooled.

Before the steam compressor 610 is driven, or in an initial driving state of the steam compressor 610, the air or the moisture that flowed into the inlet hole 6425 may be cooled more. A vicinity of the inlet hole 6425 may be at a temperature lower than that of the discharge hole 6424 because the air or the moisture has not yet been compressed, and the introduced air or moisture may be cooled more.

Accordingly, the air or the moisture may be condensed and converted into a liquid (e.g., water) w in the inlet hole 6425, and the liquid w may not be compressed in the fixed wrap 6423 and the orbiting wrap 6433. In severe cases, the liquid w may block the flow path of the fixed wrap 6423 and the orbiting wrap 6433 to block the flow of the air or the moisture, thereby making an operation of the steam compressor 610 inefficient or ineffective. Liquid w will be most condensed in or at the inlet hole 6425, which may interfere with air or moisture entering the compressor 610. Therefore, there are concerns that the steam compressor 610 may not perform as intended.

Figure 6:
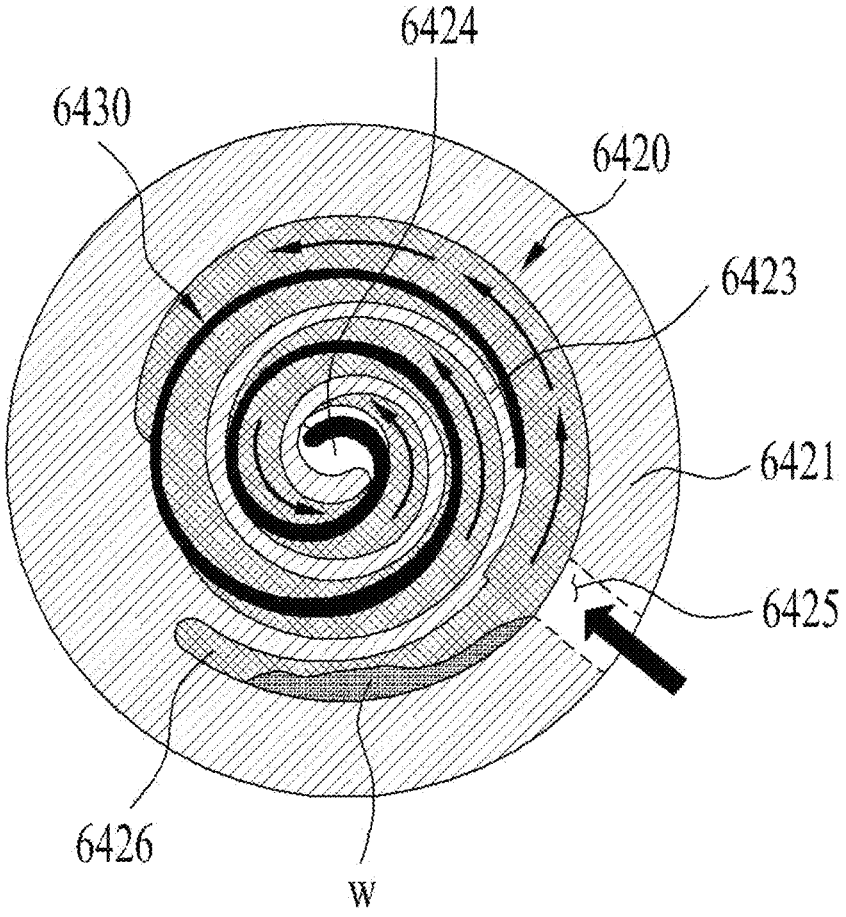
FIG. 6 shows a structure of separately storing moisture in a compressor applied to the present disclosure.

To improve this, the steam compressor 610 according to an embodiment of the present disclosure may further include a collecting portion or recess 6426 (e.g., as shown in FIG. 6) defined inside the compressing portion 6400 (e.g., in the fixed scroll 6420) to collect the liquid or water condensed from the air or the moisture therein. The collecting portion 6426 may be defined such that an inner one surface of the compressing portion 6400 may be recessed to collect the condensed water therein. The collecting portion 6426 may not prevent the condensation of the air or the moisture that flowed into the inlet hole 6425, but collect the condensate separately to prevent the condensate from blocking the flow path.

The collecting portion 6426 may be defined by recessing one surface of the fixed scroll 6420. For example, the collecting portion 6426 may be defined by recessing a portion of the fixed end plate 6421 facing the fixed wrap 6423 or a portion of the fixed end plate 6421 facing the inlet hole 6425, but embodiments disclosed herein are not limited. Alternatively or in addition thereto, the collecting portion 6426 may be defined by recessing the fixed side plate 6422.

The collecting portion 6426 may be defined by recessing a portion of the compressing portion 6400 directed in a gravity direction (i.e., downward). When the moisture, water, or liquid introduced from the inlet hole 6425 is condensed, the condensed liquid may be naturally collected in the collecting portion 6426. Accordingly, the inlet hole 6425 and the flow path may not be blocked by the condensed liquid.

Because an amount of liquid condensed in the inlet hole 6425 may be large, the collecting portion 6426 may be defined adjacent to the inlet hole 6425. FIG. 6 shows an embodiment of the collecting portion 6426. Referring to FIG. 6, the collecting portion 6426 may be defined by being recessed in the fixed side plate 6422. Accordingly, the collecting portion 6426 may not interfere with the air or the moisture flowing along the fixed wrap 6423.

The collecting portion 6426 may include an extended collecting groove 6426*a* defined by recessing the fixed side plate 6422 in the inlet hole 6425 in a direction opposite to the extension direction of the fixed wrap 6423. The liquid w condensed in the inlet hole 6425 may be collected in the extended collecting groove 6526*a* by flowing along the fixed side plate 6422 or the fixed wrap 6423.

The fixed wrap 6423 may define a flow path along which the air or the moisture flows together with the orbiting wrap 6433 from the portion of the fixed wrap 6423 facing the inlet hole 6425 to the discharge hole 6424. The extended collecting groove 6426*a* may extend in a direction opposite to the flow path from the inlet hole 6525.

Even when the air or the moisture is condensed inside the compressing portion 6400, the inlet hole 6425 or the fixed wrap 6423 and the orbiting wrap 6433 may not be blocked. Because the air or the moisture that is not condensed may be in a gaseous state, gravity may be overcome, and the gaseous air or moisture may flow toward the discharge hole 6424 along the fixed wrap 6423. The rotation shaft 6300 may be provided parallel to or inclined to the ground. The extended collecting groove 6426*a* may be defined in the fixed end plate 6421 to face the ground or extend toward the ground.

In one example, referring back to FIG. 3, the branched heater 600 of the laundry treating apparatus may extract the air of the drum 200 and compress the extracted air so that a large amount of moisture may be contained in the air. As an amount of moisture or steam supplied to the branched heater 600 is increased, an amount of air compressed by the steam compressor 610 is increased so that an efficiency of heating may be further increased. When the air is cooled, the moisture contained in the air may be easily condensed. The more moisture that is contained in the air, the more moisture may be condensed even when cooled by a same temperature difference.

The circulating portion 500 may have a lower temperature than the drum 200. Because the circulating portion 500 may not be able to be completely heat-insulated, the circulating portion 500 may exchange heat with the air inside the cabinet 100, and even exchange heat with the exterior of the cabinet 100, the ground, etc. The air discharged from the drum 200 may dissipate heat while passing through the circulating portion 500. Accordingly, a considerable amount of moisture may be condensed in the circulating portion 500. In addition, when the air is in contact with the blower fan 570, the air and the blower fan 570 may exchange heat to condense a considerable amount of moisture around the blower fan 570.

Accordingly, the air that has passed through the circulating portion 500 may lose a considerable amount of moisture before flowing into the branched heater 600, and a heating performance of the branched heater 600 may be reduced. In addition, the moisture discharged from the drum 200 may not be collected in the reservoir 560 and may remain in the flow path of the circulating portion 500. Accordingly, bacteria or other foreign matter may propagate or collect in the circulating portion 500, the components or devices inside the cabinet 100 may be oxidized, and damage (especially to electronics) may be caused.

The circulating portion 500 may be made of a heat insulating material, but may also be at a relatively lower temperature than the drum 200 at the beginning of the drying process, which may prevent a certain amount of moisture from condensing. Accordingly, the laundry treating apparatus of the present disclosure may change the structures of the heater H and the flow path of the circulating portion 500.

Referring to FIG. 7, the circulating portion 500 may further include an air flow portion 520 and a heating duct 580. The air flow portion may have one end in communication with the drum 200, and at least one of the blower fan 570 or the heat supplier 620 may be provided in the air flow portion. The heating duct 580 may have one end in communication with the air flow portion 520 and the other end in communication with the drum 200. There may be a connecting duct 581 connecting the air flow portion 520 with the heating duct 580.

The heater H may be provided inside the heating duct 580, and the heating duct 580 may be made of a material having a high heat dissipation performance or heat transfer coefficient. When the heater H is driven in the heating duct 580, the heating duct 580 may dissipate heat to the outside as a temperature of the heating duct 580 increases. The heating duct 580 may be provided to heat the air flow portion 520. When the heater H is heated, the air flow portion 520 may also be heated at the same time so that air flowing through the air flow portion 520 may not be cooled. As a result, the condensing of the air may be prevented or reduced. However, even if the moisture is condensed in the discharge connecting duct 510, the moisture may evaporate again while flowing into the air flow portion 520.

The heating duct 580 may be provided adjacent to the air flow portion 520 and also adjacent to the cabinet 100, and the air flow portion 520 may be provided farther away from the cabinet 100 than the heating duct 580. The heating duct 580 may be provided to be closer to an inner surface of the cabinet 100 than the air flow portion 520. Even when the air flow portion 520 is heated by the heating duct 580, the air flow portion 520 may be cooled in the process of the heat exchange with the cabinet 100. For example, as shown, when the circulating portion 500 is provided below the drum 200, the heating duct 580 may be provided below the air flow portion 520. Accordingly, heat loss of the air flow portion 520 to the outside of the cabinet 100 may be reduced or prevented.

The heating duct 580 and the air flow portion 520 may be in contact with each other. The heating duct 580 and the air flow portion 520 may partially overlap with each other, and heat may be evenly supplied to an entire area of the air flow portion 520 to prevent or reduce a possibility of the moisture from condensing. For example, one surface of the heating duct 580 may be in contact with the air flow portion 520, and the other surface thereof may be in contact with or adjacent to a bottom surface of the cabinet 100.

In one example, in order to arrange or configure the heating duct 580 to heat the air flow portion 520, a direction of the air flowing through the heating duct 520 and a direction of the air flowing through the air flow portion 520 may be different from each other. The direction of the air flowing inside the heating duct 520 and the direction of the air flowing inside the air flow portion 520 may be opposite to each other. The suction connecting duct 540 and the discharge connecting duct 510 may be arranged in a same direction on one side surface, forward, or rearward of the drum 200.

Both the suction duct 412 and the discharge duct 411 may be arranged rearward or forward of the drum. For example, the suction duct 412 and the discharge duct 411 may be arranged to be spaced apart from each other along a height or vertical direction of the cabinet 100. The suction duct 412 may be provided below or above the discharge duct 520. The suction connecting duct 540 may include a first connecting duct 541 in communication with the heating duct 580, a second connecting duct 543 in communication with the suction duct 412, and an extended duct 542 for connecting the first connecting duct and the second connecting duct to each other 542.

Referring to FIG. 8, the extended duct 542 may be provided inside a door 150 to open and/or close the opening of the cabinet 100 and may be detachably coupled to the first connecting duct 541 and the second connecting duct 543. The door 150 may alternatively be referred to as a cover. When closed, the door 150 may be adjacent to a surface or edge 582 of the cabinet 100. A space occupied by the suction connecting duct 540 in the cabinet 100 may be reduced. Alternatively, the first connecting duct 541 may be provided in the door 150, and may be detachably connected to the heating duct 580.

When the drying process starts, the heater H may be controlled to be driven or operated. The heating duct 580 may be heated, and the heat dissipated from the heating duct 580 may be transferred to the air flow portion 520 in III direction. The air flow portion 520 may be heated and prevent or reduce a condensing of the air passing through the air flow portion 520. Because the heat supplier 620 and the blower fan 520 may also be heated, a cooling of the air may be prevented or reduced even when the air comes into contact with the heat supplier 620 and the blower fan 520. Even before the branched heater 600 is operated, the air may come into contact with the heat supplier 620 to prevent or reduce condensation of the moisture in the air.

When the drying process is started, the blower fan 570 may be driven or operated, and the heater H may be driven together or sequentially with the blower fan 570. In one example, the heater H may be heated before the blower fan 570 in order to heat the air flow portion 520 first.

The air may flow into the air flow portion 520 through the discharge duct 411. Because the air may initially be in a state of not containing much moisture, the air may pass through the air flow portion 520 without being condensed and flow into the heating duct 580.

The air may be heated by the heater H and flow into the drum 200. The heated air may contain moisture while or after drying the laundry of the drum 200 and may be discharged to the discharge duct 411. Because the air flow portion 520, the blower fan 570, and the branched heater 600 are heated, most or all of the air may not be condensed and may flow into the heating duct 580 again.

When the heater H and the blower fan 570 are driven for a reference or predetermined time or longer, the air that flowed into the discharge duct 411 may contain moisture equal to or above a reference or predetermined value, which is an amount that may trigger an operation of the steam compressor 610 so that the moisture may be compressed and heated in the steam compressor 610. The branch determining portion 640 may open the branch pipe 630 to inject a portion of the air into the steam compressor 610. The steam compressor 610 may be driven or operated, and the heat supplier 620 may be driven or operated to heat the air passing through the air flow portion 520. Most or all of the air passing through the air flow portion 520 may be prevented from further being condensed.

In one example, when the heat supplier 620 is driven, the driving of the heater H may be stopped. When the air is condensed in the heating duct 580, the condensed air may be collected in the reservoir 560. However, when the air is cooled in the heating duct 580, a drying efficiency may decrease, so the heater H may continue to operate. The heater H may be controlled to operate whenever a temperature of the heating duct 580 is lower than a specific or predetermined value. The heating duct 580 may have a temperature sensor.

In one example, the circulating portion 500 or the branched heater 600 may be installed with a humidity sensor to sense a humidity of the air. When the humidity of the air flowing through the air flow portion 520 is equal to or greater than a reference or predetermined humidity after the heater H is operated, the branch pipe 630 may be opened.

In one example, the blower fan 570 may be provided upstream of the heat supplier 620 in the air flow portion 520 to reduce a risk of moisture condensation from an initial temperature of the heat supplier 620 being low as the heat supplier 620 is provided as the heat exchanger. When the blower fan 570 starts to rotate, friction heat and drive heat may be generated. Even when the moisture is partially condensed, the condensed moisture may be vaporized as wind. The blower fan 570 may be provided to contact the air before the heat supplier 620.

Referring to FIG. 9, FIG. 9 shows an embodiment similar to an embodiment shown in FIG. 8, except that the heat supplier 620 may be provided upstream of the blower fan 570. In order to avoid overlapping descriptions, description will be made focusing on other components.

In the air flow portion 520, the heat supplier 620 may be provided upstream of the blower fan 570. Heat may be generated when the heat supplier 620 is driven, so that the air discharged from the drum 200 is further heated, which may further prevent or reduce condensation of the air flowing toward the blower fan 570. The heat supplier 620 may also heat the blower fan 570 with the hot air so that condensation of the air may be prevented or reduced even when contacting the blower fan 570.

The present disclosure may be modified implemented in various forms, so that the scope thereof is not limited to the above-described embodiment. Therefore, when including the components of the claim of the present disclosure, the modified embodiment should be regarded as belonging to the scope of the present disclosure.

Embodiments disclosed herein may provide a laundry treating apparatus capable of compressing and heating air or moisture discharged from the drum. Embodiments disclosed herein may provide a laundry treating apparatus capable of compressing a portion of air or moisture discharged from the drum to heat a portion of air or moisture flowing into the drum.

Embodiments disclosed herein may provide a laundry treating apparatus capable of utilizing energy contained in air discharged from the drum. Embodiments disclosed herein may provide a laundry treating apparatus capable of omitting an apparatus for circulating a refrigerant provided separately from air or moisture or storing the refrigerant therein.

Embodiments disclosed herein may provide a laundry treating apparatus that prevents air circulating in the laundry treating apparatus from being condensed before being flowed into the compressor. Embodiments disclosed herein may provide a laundry treating apparatus capable of preventing air from condensing randomly while circulating.

Embodiments disclosed herein may provide a laundry treating apparatus capable of heating a duct through which air circulates using a separate flow path. Embodiments disclosed herein may provide a laundry treating apparatus in which a heater is provided near a blower fan and a heat exchanger in order to solve the above-mentioned problems.

Air circulating through a laundry treating apparatus may be vulnerable to heat dissipation, and the laundry treatment apparatus using a steam compressor may be low in a drying efficiency, as increase of a laundry temperature is hindered when condensation is generated. Even when a duct through which the air circulates is heat-insulated in order to prevent this, heat loss may occur in a cycle when a temperature is equal to or above 60° C. In addition, the condensation may be inevitably generated in a portion having a relatively low temperature.

Therefore, embodiments disclosed herein may provide a portion (the blower fan, the heat exchanger, and a drum), which is weak in terms of heat dissipation, near the heater. The heater may be installed to be adjacent to the blower fan or the heat exchanger.

The heat dissipated from the heater may initially remove the condensation that is generated at a drum outlet, the blower fan, and the heat exchanger, and may rapidly vaporize the generated condensation. As a result, a performance of the steam compressor may be improved, the increase of the laundry temperature may be induced, and a drying time and a power consumption may be reduced.

In addition, embodiments disclosed herein may be installed such that a flow path through which the air is discharged from the drum and a flow path through which the air is introduced are arranged in only one direction. Therefore, a heating duct and an air flow duct may be arranged or configured such that directions of air flowing through the ducts are different from each other. In addition, a space in which the condensate is collected may be provided below a heater. Embodiments disclosed herein may install a condensate water or liquid trap to remove the condensate water, or vaporize the condensate water to induce the condensate water to circulate the drum again. A power supply of the heater may be upwardly directed to prevent electric accidents caused by the condensate water.

Embodiments disclosed herein may provide a laundry treating apparatus including a cabinet, a laundry accommodating portion provided inside the cabinet to accommodate laundry therein, a circulating portion connected to the laundry accommodating portion to circulate air containing moisture discharged from the laundry inside the laundry accommodating portion, a branched heater to heat the air circulating the circulating portion, a blower fan to provide power to allow the air to flow through the circulating portion and the laundry accommodating portion, and a heater provided separately from the branched heater to heat the air flowing into the drum from the circulating portion.

The circulating portion may further include a discharge duct to discharge air in the laundry accommodating portion and a suction duct to connect the laundry accommodating portion with a heating duct to introduce air into the laundry accommodating portion. The suction duct and the discharge duct may both be arranged in the same direction on the basis of the laundry accommodating portion.

In one implementation, the circulating portion may further include an air flow duct having one end in communication with the discharge duct and having the branched heater installed therein, and a heating duct having one end in communication with the air flow duct and the other end in communication with the suction duct and having the heater installed therein. In one implementation, the heating duct and the air flow duct may be arranged such that a direction of air flowing through the heating duct and a direction of air flowing through the air flow duct are different from each other. In one implementation, the air flow duct may be provided between the heating duct and the laundry accommodating portion. In one implementation, the air flow duct may be provided to be heated by the heating duct.

Embodiments disclosed herein may compress and heat the air or the moisture discharged from the drum. Embodiments disclosed herein may compress the portion of the air or the moisture discharged from the drum to heat the portion of the air or the moisture flowing into the drum. Embodiments disclosed herein may utilize the energy contained in the air discharged from the drum. Embodiments disclosed herein may omit an apparatus designed to circulate a refrigerant provided separately from the air or the moisture or storing the refrigerant therein.

Embodiments disclosed herein may prevent the air circulating in the laundry treating apparatus from being condensed before being flowed into the compressor. Embodiments disclosed herein may prevent the air from condensing randomly while circulating. Embodiments disclosed herein may heat the duct through which the air circulates using the separate flow path.

Embodiments disclosed herein may be implemented as a laundry treating apparatus comprising a cabinet having a drum configured to store laundry therein, an air flow passage communicating with the drum, a heating duct communicating with the air flow passage and the drum, a first heater provided in the heating duct and configured to heat air flowing into the drum, a blower fan provided in the air flow passage and configured to suction air into the air flow passage and circulate air containing moisture from the laundry inside the drum, a branch pipe communicating with the air flow passage so that at least a portion of the air flowing through the air flow passage flows through the branch pipe, a steam compressor to compress the air flowing into the branch pipe, a second heater provided in the air flow passage and configured to heat the air circulating in the air flow passage, and a cooling duct through which air outside the cabinet may be suctioned to cool the air that may have passed through the steam compressor and the second heater.

The blower fan may be provided downstream of the second heater with respect to a flow direction of air through the air flow passage. The heating duct may be provided closer to an inner surface of the cabinet than the air flow passage. The air flow passage may be vertically aligned with the heating duct. The heating duct and the air flow passage may contact each other. A first surface of the heating duct may contact the air flow passage, and a second surface of the heating duct may be adjacent to the cabinet. The first heater may be provided below the blower fan. The heating duct and the air flow passage may be arranged such that a direction of air flowing through the heating duct and a direction of air flowing through the air flow passage are different from each other.

An outlet duct may connect the drum with the air flow passage to discharge air in the drum. An inlet duct may connect the drum with the heating duct to introduce heated air into the drum. The inlet duct and the outlet duct may be spaced apart from each other in a vertical direction.

A valve may be coupled to the branch pipe to adjust an opening or closing of the branch pipe. A controller may be configured to control the valve. The controller may be configured to control the valve to open the branch pipe when at least one of the first heater or the blower fan may be operated for a predetermined time period or longer.

A humidity sensor may sense a humidity of the air flowing into the branch pipe. A controller may be configured to control the valve. The controller may be configured to control the valve to open the branch pipe when the humidity sensor senses that the humidity of the air may be equal to or above a predetermined humidity.

A controller may be configured to control the first and second heaters. The controller may be configured to control an operation of the first heater to begin before an operation of the second heater.

A controller may be configured to control the first and second heaters. The controller may be configured to control an operation of the first heater to stop after an operation of the second heater may have started or may be configured to operate the first heater periodically based on predetermined time periods.

Embodiments disclosed herein may be implemented as a laundry treating apparatus comprising a cabinet, a drum provided inside the cabinet to store laundry therein, a heating duct communicating with the drum, a first heater provided in the heating duct and configured to heat air flowing into the drum, at least one circulating duct communicating with the drum, a blower fan provided in the circulating duct and configured to suction air into the circulating duct and circulate air containing moisture from the laundry inside the drum, a second heater provided in the circulating duct and configured to heat the air circulating in the circulating duct, an outlet duct communicating with the drum and the circulating duct through which air from the drum may be discharged, and an inlet duct connecting the drum with the heating duct to introduce heated air into the drum. An inlet of the inlet duct and an inlet of the outlet duct may be provided at a same side of the drum.

An air flow passage may communicate with the outlet duct. The second heater may be provided in the air flow passage. The heating duct may communicate with the air flow passage and the inlet duct.

The heating duct and the air flow passage may be configured such that a direction of air flowing through the heating duct and a direction of air flowing through the air flow passage are different from each other.

The air flow passage may be provided between the heating duct and the drum. A position of the air flow passage relative to the heating duct may be configured such that the air flow passage may be heated by the heating duct.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a cabinet having a drum configured to store laundry therein;

an air flow passage communicating with the drum;

a heating duct communicating with the air flow passage and the drum;

a first heater provided in the heating duct and configured to heat air flowing into the drum;

a blower fan provided in the air flow passage and configured to suction air into the air flow passage and circulate air containing moisture from the laundry inside the drum;

a branch pipe communicating with the air flow passage so that at least a portion of the air flowing through the air flow passage flows through the branch pipe;

a steam compressor to compress the air flowing into the branch pipe;

a second heater provided in the air flow passage and configured to heat the air circulating in the air flow passage with the air compressed in the steam compressor; and a cooling duct through which air outside the cabinet is suctioned to cool the air that has passed through the steam compressor and the second heater.

2. The laundry treating apparatus of claim 1, wherein the blower fan is provided downstream of the second heater with respect to a flow direction of air through the air flow passage.

3. The laundry treating apparatus of claim 1, wherein the heating duct is provided closer to an inner surface of the cabinet than the air flow passage.

4. The laundry treating apparatus of claim 3, wherein the air flow passage is vertically aligned with the heating duct.

5. The laundry treating apparatus of claim 3, wherein the heating duct and the air flow passage contact each other.

6. The laundry treating apparatus of claim 5, wherein a first surface of the heating duct contacts the air flow passage, and a second surface of the heating duct is adjacent to the cabinet.

7. The laundry treating apparatus of claim 3, wherein the first heater is provided below the blower fan.

8. The laundry treating apparatus of claim 3, wherein the heating duct and the air flow passage are arranged such that a direction of air flowing through the heating duct and a direction of air flowing through the air flow passage are different from each other.

9. The laundry treating apparatus of claim 8, further comprising:

an outlet duct connecting the drum with the air flow passage to discharge air in the drum; and an inlet duct connecting the drum with the heating duct to introduce heated air into the drum.

10. The laundry treating apparatus of claim 9, wherein the inlet duct and the outlet duct are spaced apart from each other in a vertical direction.

11. The laundry treating apparatus of claim 1, further comprising a valve coupled to the branch pipe to adjust an opening or closing of the branch pipe.

12. The laundry treating apparatus of claim 11, further comprising a controller configured to control the valve, wherein the controller is configured to control the valve to open the branch pipe when at least one of the first heater or the blower fan is operated for a predetermined time period or longer.

13. The laundry treating apparatus of claim 11, further comprising:

a humidity sensor to sense a humidity of the air flowing into the branch pipe, and a controller configured to control the valve, wherein the controller is configured to control the valve to open the branch pipe when the humidity sensor senses that the humidity of the air is equal to or above a predetermined humidity.

14. The laundry treating apparatus of claim 1, further comprising a controller configured to control the first and second heaters, wherein the controller is configured to control an operation of the first heater to begin before an operation of the second heater.

15. The laundry treating apparatus of claim 1, further comprising a controller configured to control the first and second heaters, wherein the controller is configured to control an operation of the first heater to stop after an operation of the second heater has started, or is configured to operate the first heater periodically based on predetermined time periods.

16. A laundry treating apparatus, comprising:

a cabinet;

a drum provided inside the cabinet to store laundry therein;

a heating duct communicating with the drum;

a first heater provided in the heating duct and configured to heat air flowing into the drum;

at least one circulating duct communicating with the drum;

a blower fan provided in the circulating duct and configured to suction air into the circulating duct and circulate air containing moisture from the laundry inside the drum;

a second heater provided in the circulating duct and configured to heat the air circulating in the circulating duct;

an outlet duct communicating with the drum and the circulating duct through which air from the drum is discharged; and an inlet duct connecting the drum with the heating duct to introduce heated air into the drum, wherein an inlet of the inlet duct and an inlet of the outlet duct are provided at a same side of the drum.

17. The laundry treating apparatus of claim 16, further comprising an air flow passage communicating with the outlet duct, wherein the second heater is provided in the air flow passage, and the heating duct communicates with the air flow passage and the inlet duct.

18. The laundry treating apparatus of claim 17, wherein the heating duct and the air flow passage are configured such that a direction of air flowing through the heating duct and a direction of air flowing through the air flow passage are different from each other.

19. The laundry treating apparatus of claim 17, wherein the air flow passage is provided between the heating duct and the drum.

20. The laundry treating apparatus of claim 17, wherein a position of the air flow passage relative to the heating duct is configured such that the air flow passage is heated by the heating duct.

* * * * *